US005215225A

United States Patent [19]

Kopp

[11] Patent Number: 5,215,225

[45] Date of Patent: Jun. 1, 1993

[54] APPARATUS FOR A DISPENSING OF A MIXTURE CONSISTING OF AT LEAST TWO COMPONENTS

[75] Inventor: Volker Kopp, Esslingen, Switzerland

[73] Assignee: C. Ehrensperger AG, Stafa, Switzerland

[21] Appl. No.: 766,051

[22] Filed: Sep. 26, 1991

[30] Foreign Application Priority Data

Oct. 26, 1990 [CH] Switzerland ..... 3426/90

[51] Int. Cl.[5] ..... B67D 5/56

[52] U.S. Cl. ..... 222/129; 222/153; 206/219

[58] Field of Search ..... 222/1, 129, 136, 145, 222/153; 206/219, 222

[56] References Cited

U.S. PATENT DOCUMENTS

| | | | |
|---|---|---|---|
| 2,793,776 | 5/1957 | Lipari . | |
| 3,200,995 | 8/1965 | Gangwisch | 222/145 X |
| 3,870,147 | 3/1975 | Orth | 222/129 X |
| 4,651,899 | 3/1987 | Pauls et al. . | |
| 4,657,534 | 4/1987 | Beck et al. . | |
| 4,905,825 | 3/1990 | Brader . | |

FOREIGN PATENT DOCUMENTS 2758017 7/1979 Fed. Rep. of Germany ..... 222/145

*Primary Examiner*—Gregory L. Huson

*Attorney, Agent, or Firm*—Fay, Sharpe, Beall, Fagan, Minnich & McKee

[57] ABSTRACT

The apparatus includes a first chamber which is formed by a container and includes further a second chamber in a cylinder shaped body and defined by two chamber defining members located displaceable in the cylinder shaped body and sealed at their circumference against the inner surface thereof. These chamber defining members are frictionally engaged by an operating member which projects through the close-off member of the valve of the apparatus towards the outside. By a pulling of this operating member the second chamber, in which a second component is positioned, is dislocated relative to the cylinder shaped body and the first chamber, in which a first component is located, until the second component is forced out of the cylinder shaped body. The arrangement guarantees, that the second component is completely fed into the first component to produce a mixture consisting of these two components.

12 Claims, 3 Drawing Sheets

25
24
18
30
27
19
23
7
41
42
10
13
17
9
14
20
15
11

37
39
31
38
33
36
35
27
27
32

APPARATUS FOR A DISPENSING OF A MIXTURE CONSISTING OF AT LEAST TWO COMPONENTS

BACKGROUND OF THE INVENTION

1. Field of the Invention

The present invention relates to an apparatus for a dispensing of a mixture consisting of at least two components and having a first and a second chamber, which first chamber includes a dispensing valve and is adapted for receipt of a first component of the mixture, and which second chamber is positioned within the first chamber and is adapted for receipt of a second component of the mixture.

2. Description of the Prior Art

Such apparatuses are generally known for a large variety of applications and in various designs.

The international application WO 85/00157 discloses an apparatus which includes a container and an auxiliary container having a cover located therein. A rod is positioned in the auxiliary container, which rod extends via an auxiliary switching connection out of the container and is designed to allow a displacement thereof in order to forcefully remove the cover of the auxiliary container in the container.

This known apparatus features specifically the drawback, that the second component in the auxiliary container is to be brought into the first component by a shaking operation, wherewith the complete emptying of the auxiliary container is not guaranteed.

SUMMARY OF THE INVENTION

A general object of the present invention is to provide an apparatus for dispensing a mixture consisting of at least two components which leads to an impeccable mixing by a complete bringing together of the components and which features, furthermore, low production costs and an extremely easy and safe manipulation.

A further object is to provide an apparatus which includes a container, a cylinder shaped body positioned in the container, and at least a first and a second chamber for receipt of a respective component of a mixture, whereby the second chamber is defined by a longitudinal portion of the cylinder shaped body and at least a first and a second chamber defining member, which chamber defining members are located at a distance from each other inside of the cylinder shaped body, are displaceable relative thereto and contact the inner wall surface of the cylinder shaped body in a sealed manner; which apparatus comprises further an operating member adapted to be operated from the outside of the container and frictionally engaging the at least first and the second chamber defining members, and a fluid communication port positioned in the cylinder shaped body, whereby a displacing of the operating member causes due to the frictional engagement with the at least first and second chamber defining members a displacement of same and accordingly of the second chamber towards the fluid communication port and thus a fluid communication between the at least second and the first chambers in order to force the second component of the mixture from the second chamber into the first chamber.

Yet a further object of the invention is to provide an apparatus for dispensing a mixture consisting of at least two components, in which the dispensing of the mixture proceeds without any overpressure or superpressure caused by a reaction of the components being mixed or without any propellant gas.

A further object of the invention is to provide an apparatus, in which all chambers containing a component of the mixture are subjected to the same pressure relations such that the second chamber must not be sealed against a higher pressure.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 1C:
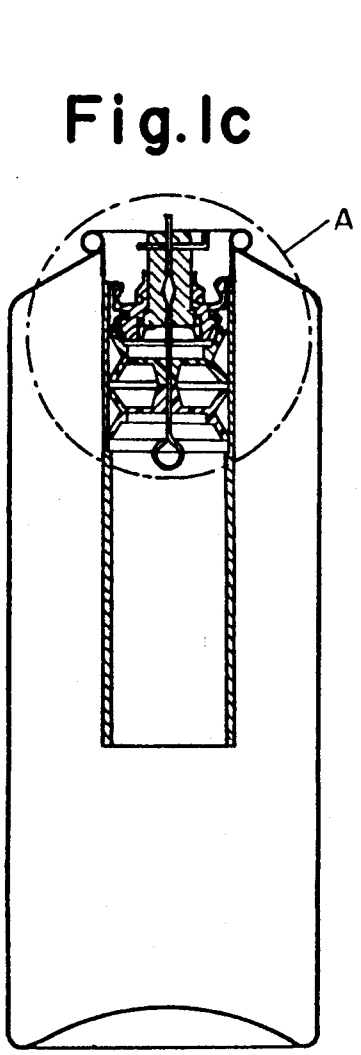
FIGS. 1*a* to 1*c* are cross sections through an embodiment of the apparatus structured in accordance with the invention and illustrating three various positions of the second chamber inside the first chamber.
Figure 1B:
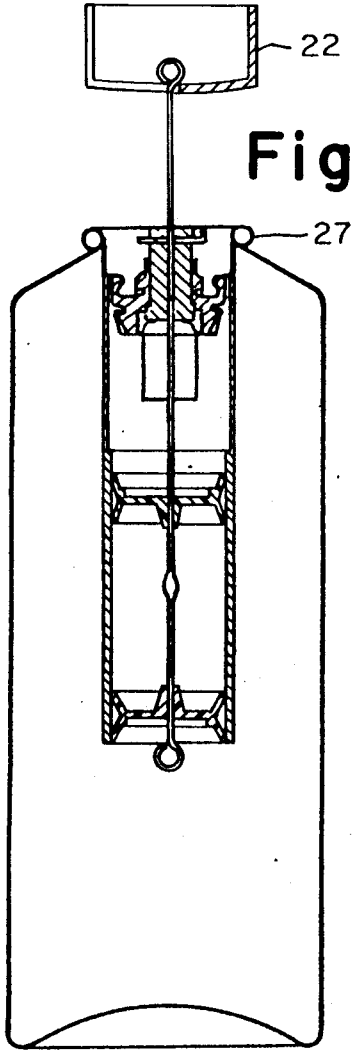
Figure 1A:
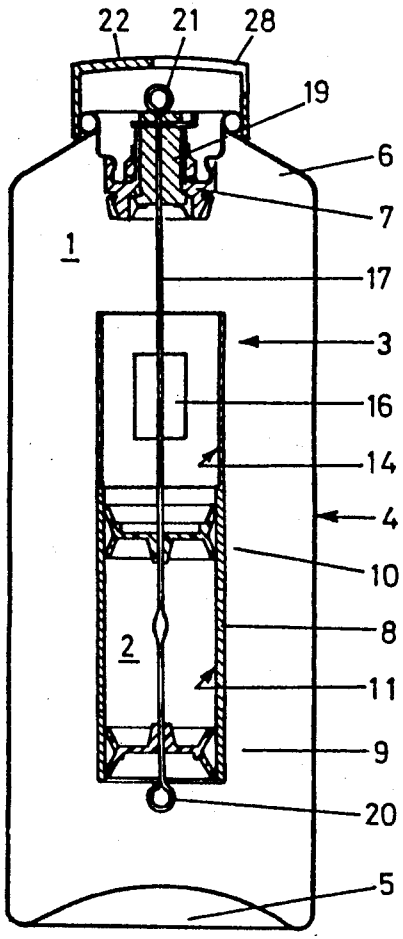

FIG. 1*a* illustrates a first embodiment of the apparatus in a state immediately after its production. FIG. 1*b* illustrates the apparatus in an intermediate state prior to its use. FIG. 1*c* illustrates the apparatus ready for operation, i.e. dispensing.

The apparatus is basically divided into a first chamber 1 and a second chamber 2 and includes, furthermore, a mixing unit 3 for a mixing of the components filled into the two chambers 1, 2.

The first chamber 1 is formed by an outer, cylinder shaped container 4 having a bottom section 5 and a top section 6. A dispensing valve 7 for the dispensing of the mixture is located in the top section 6.

The second chamber 2 is formed by a portion of a cylinder shaped body 8 and two pistons 9, 10. These two pistons 9, 10 are located at a distance from each other and are displaceable in a first portion 11 of the cylinder shaped body and contact the inner wall surface thereof in a sealed manner. The pistons 9, 10 comprise each two annular sections 13 (see specifically FIG. 2), which form together with the inner wall surface of the first portion 11 of the cylinder shaped body 8 three sealing areas. The cylinder shaped body 8 includes a second portion 14 adjacent the first portion 11—here above the second chamber 2—which second portion 14 has a larger inner diameter of the first portion 11 such that an annular opening 15 is present between the surface of the inner wall of the cylinder shaped body 8 and the jacket surface of the annular sections 13 of the pistons 9, 10 such that in the state shown in FIG. 2 a fluid communication between the first chamber 1 and the second chamber 2 is established together with an opening 16 located in the wall of the second section 14, thus insuring the fluid communication between the first chamber 1 and the second chamber 2.

Figure 2:
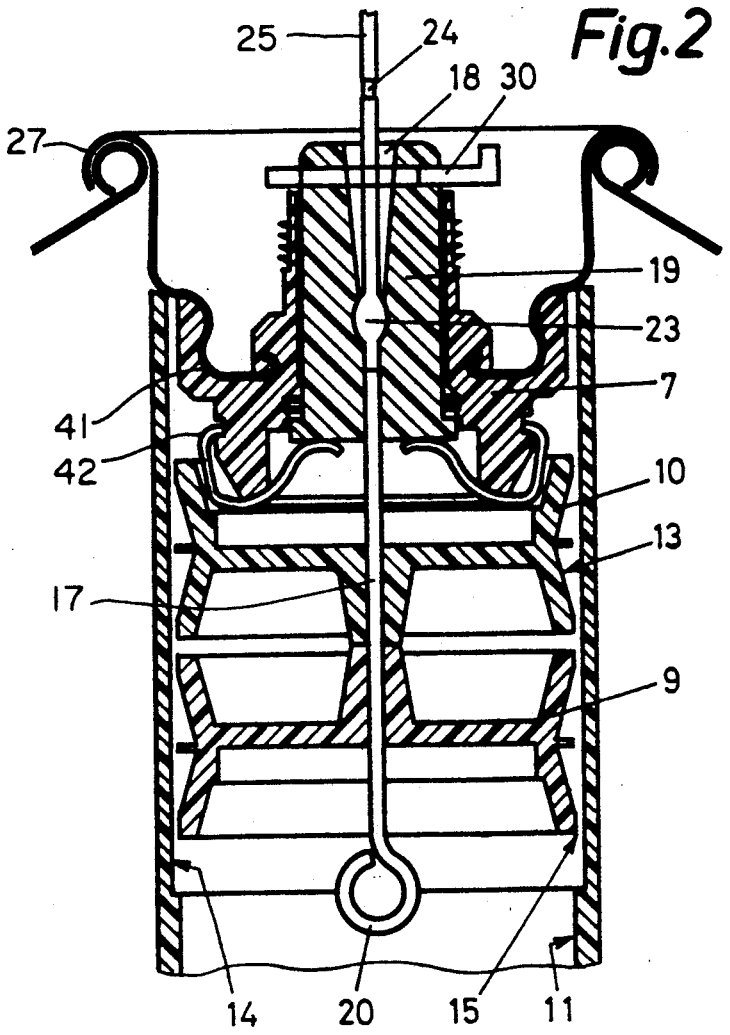
FIG. 2 illustrates on a somewhat enlarged scale a detail of FIG. 1*c;*

An operating member 17 contacts or engages, respectively, frictionally the two pistons 9, 10, which operating member 17 extends through an opening 18 in the close-off member 19 of the dispensing valve 7 towards the outside of the container (see FIG. 2). This operating member 17 is a wire having loops 20, 21 at its respective ends. The loop 20 of the wire 17 inside of the container acts as abutment for the lower piston 9 and the opposite loop 21 located at the outside acts as abutment for a pulling member 22 (see FIG. 1*b*). The operating member 17 includes, furthermore, an arresting section 23 and a predetermined breaking point 24. By means of the arresting section 23 the operating member 17 is arrested after an emptying of the second chamber 2 in the dispensing valve 7 and the predetermined breaking point 24 allows a removing of the projecting part 25 of the operating member 17 which has been pulled upwards (FIG. 1*b*) prior to the dispensing of the mixture.

The pulling member 22 is at the same time designed as closure for the apparatus. Hereto this member has the shape of a cup and is snapped onto the edge 27 of the container 4. The cap includes a slot 28 such that the cap can be brought to engage and grip the operating member 17 under the loop 21 (FIG. 1*b*).

The components are filled into the apparatus according to the following procedure. The second component is fed firstly into the second chamber 2. This feeding is made at an assembly consisting of the mixing unit 3, the operating member 17 and the dispensing valve 7, which arrangement is at this feeding state separate, i.e. removed from the container 4. The piston 9 is pulled out of the cylinder shaped body 8 by pulling the lower loop 20 and accordingly the second chamber 2 is open at its bottom. Now the second component is filled into the second chamber 2 and thereafter the piston 9 is replaced such that the second chamber 2 is closed off.

Then (or at the same time or prior to above filling, respectively) the first component is filled into the first chamber 1. Thereafter the above assembly having the filled second chamber is inserted into the container 4 through the opening provided for the dispensing valve 7. Thereafter, the container is closed off.

It shall be noted that the above mentioned filling procedure does not describe any special measures to be taken when filling the first and the second chamber, which measures may depend on the prevailing components and are very well known to the person skilled in the art.

In order to mix the components mentioned pulling member 22 is brought to engage the operating member 17 under the loop 21 such as illustrated in FIG. 1*b* and is pulled thereafter upwards such that the cylinder shaped body 8 and obviously the second chamber 2 formed therein is displaced towards the dispensing valve until the face end of the cylinder shaped body 8 abuts the inner surface of the dispensing valve 7 (FIG. 1*b*). At the continued pulling the operating member 17 is pulled upwards further such that the second chamber and the second component of the mixture present therein is displaced further in the direction towards the second portion 14 in the cylinder shaped body 8 until the leading piston 10 is located inside of the second portion 14 of the cylinder shaped body 8. In this instance a fluid communication is present between the first and the second chamber 1, 2 via the opening 16 of the cylinder shaped body 8. By a further continued pulling of the operating member 17 the second component is forced by the piston 9 acting thereupon positively and completely out of the second chamber 2. If this dispensing of the second component is terminated, the pistons 9, 10 are in the position as most clearly visible in FIG. 2. In this position the free cylinder shaped body 8 can move slowly again down towards the floor or bottom, respectively, of section 5 of the container 4. The apparatus is now ready for use. The mixture can be now dispensed.

FIG. 2 discloses, furthermore, that the apparatus includes a locking member 30, which prevents a nonintentional operating of the close-off member 19 of the dispensing valve. This locking member 13 is inserted into a groove formed in the close-off member 19 and projects from the close-off member 19 such that a pushing in motion of the close-off member 19 for an opening of the dispensing valve 7 is blocked, i.e. not possible.

Figure 3:
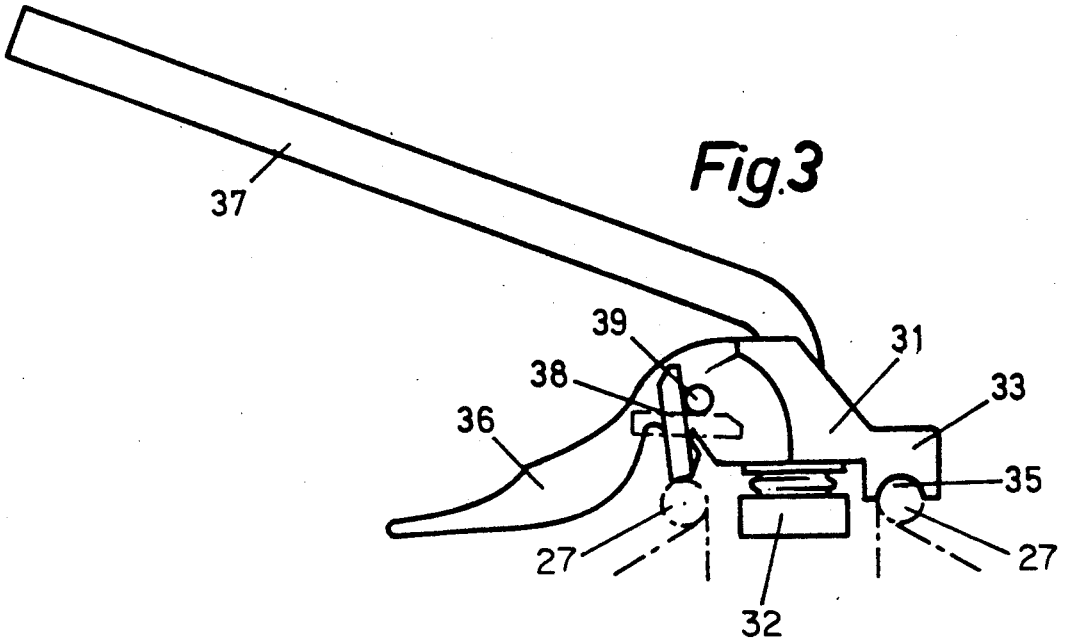
FIG. 3 is a view of a dispensing device for the apparatus structured in accordance with the present invention.

FIG. 3 illustrates an embodiment of an angle adapter structured in accordance with the invention, which can be used at the described apparatus. This angle adapter includes an adapter member 31 having a connecting stub 32 for a placing thereof onto the close-off member 19 of the dispensing valve 7, includes further a supporting portion 33 which has a recess 35 corresponding to the edge 27 of the container and allowing a plugging thereonto and, furthermore, a handle portion 36, by means of which the close-off member 19 of the dispensing valve 7 can be pushed inwards and finally a tube 37, through which the mixture is dispensed. Specifically advantageous is the feature, that the angle adapter includes further a locking catch 38, which can be adjusted at the adapter member in two positions, and furthermore, an abutment 39 which is made integrally with the adapter member. In FIG. 3 the locking catch 38 is designed in its locking position, in which it rests on the edge 27 of the container. In this position an operating of the close-off member 19 of the dispensing valve 7 by means of the handle portion 36 is prevented.

The close-off member 19 can be operated when the blocking catch is in the position illustrated in FIG. 3 by broken lines. The dispensing valve 7 has a valve body 41 and one spring member 42, to bias the close-off member 19 against the valve seat.

Figure 5:
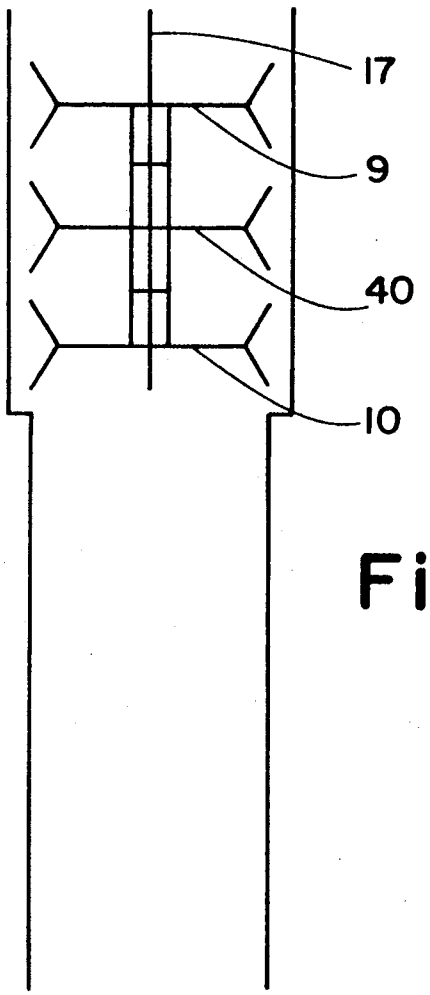
FIG. 5 illustrates the embodiment of FIG. 4 reads for operation.
Figure 4:
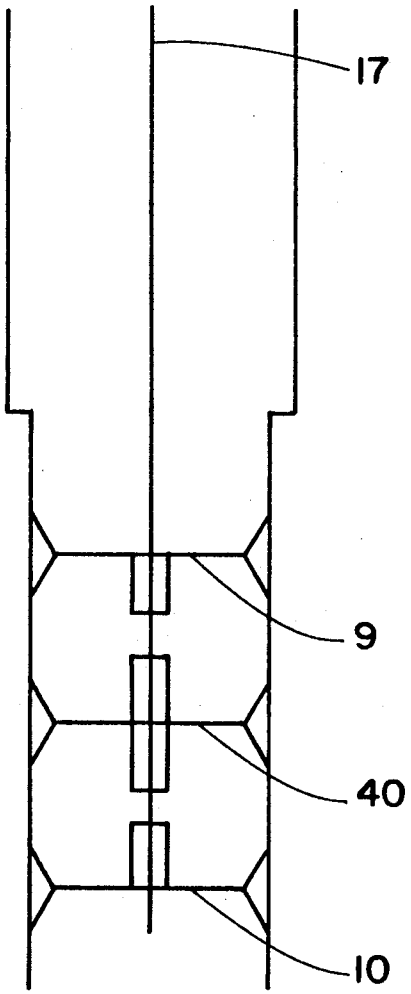
FIG. 4 is a schematic section of an embodiment with three chambers in a state prior to its use.

The above exemplary description refers to an embodiment having two chambers. FIGS. 4 and 5 illustrate schematically an embodiment with three chambers. Hereto three pistons 9, 10, 40 are installed whereby the operation is the same as described above. FIG. 4 shows the state of the pistons corresponding to that of FIG. 1*a* and FIG. 5 shows the state corresponding to FIG. 1*c*.

While there are shown and described present preferred embodiments of the invention, it is to be distinctly understood that the invention is not limited thereto, but may be otherwise variously embodied and practiced within the scope of the following claims.

I claim:

1. An apparatus for dispensing of a mixture consisting of at least two components and having a first and at least one second chamber, which first chamber includes a dispensing valve and is adapted for receipt of a first component of the mixture, and which at least one second chamber is positioned within said first chamber and each chamber is adapted for receipt of a further component of the mixture, said apparatus comprising a container and a cylinder shaped body positioned in said container, whereby said at least one second chamber is defined by a longitudinal portion of said cylinder shaped body and two chamber defining members, which chamber defining members are located at a distance from each other inside of said cylinder shaped body, are displaceable relative thereto and contact the inner wall surface of the cylinder shaped body in a sealed manner; comprising further an operating member adapted to be operated from the outside of said container and frictionally engaging said chamber defining members, and a fluid communication port positioned in said cylinder shaped body, whereby a displacing of said operating member causes due to the frictional engagement with said chamber defining members a displacement of same and accordingly of said at least one second chamber towards said fluid communication port and thus a fluid communication between said at least one second and said first chamber in order to force the second component of the mixture from the at least one second chamber into the first chamber.

2. The apparatus of claim 1 and having three chambers, comprising a first, a second and a third chamber defining member which third chamber defining member is located between the first and said second chamber defining members in order to form second and a third chamber inside of said cylinder shaped body and adapted to receive second and a third component of the mixture.

3. The apparatus of claim 1, in which said cylinder shaped body is open at both ends and has a first portion of a first diameter and a second portion of a second diameter, which second diameter is larger than the first diameter, which first portion encases the at least one second chamber, whereby the difference of the diameters of the two portions of the cylinder shaped body serves for the forming of a fluid communication between the first and the at least one second chamber.

4. The apparatus of claim 3, in which the longitudinal extent of said second portion of said cylinder shaped body exceeds the combined longitudinal extend of all chamber defining members, such that when the chamber defining members are displaced to contact each other and be positioned in said second portion, there is no contact between said chamber defining members and said cylinder shaped body.

5. The apparatus of claim 1, in which said fluid communication port includes at least one opening in the wall of said cylinder shaped body adapted to establish a fluid communication between the chambers.

6. The apparatus of claim 5, in which said cylinder shaped body is open at both ends and has a first portion of a first diameter and a second portion of a second diameter which is larger than the first diameter, and in which said at least one opening is located in the second portion of the cylinder shaped body.

7. The apparatus of claim 1, in which said chamber defining members are designed as pistons.

8. The apparatus of claim 1, in which said first chamber is formed by said container, which container includes said dispensing valve, which dispensing valve has a valve body, and in which said operating member extends through said valve body towards the outside of the container.

9. The apparatus of claim 1, further comprising a pulling member adapted to be coupled to or uncoupled from said operating member outside of said first chamber.

10. The apparatus of claim 1, in which said operating member is an elongated structure and includes an arresting section and a predetermined breaking point, whereby the operating member after having been operated can be arrested and a part thereof removed, respectively.

11. The apparatus of claim 1, and including a shut-off valve having a valve body and a close-off member for a closing and opening, respectively, of the valve, and a spring element adapted to bias the close-off member against the valve seat, in which said close-off member has a free end having a groove, and in which a locking member is inserted in said groove in order to prevent an accidental operating of the close-off member.

12. The apparatus of claim 1, further comprising an angle adapter member adapted to be positioned onto the container for a dispensing of the mixture, which angle adapter member includes a supporting portion for a connecting of the angle adapter member to an edge of the container, and a blocking catch which in one position rests on the edge of the container in order to block a close-off member of the dispensing valve and in a further position is located at a distance from the edge of the container to enable operation of the close-off member of the dispensing valve.

* * * * *